United States Patent [19]

Asbell et al.

[11] Patent Number: 4,812,794

[45] Date of Patent: Mar. 14, 1989

[54] ELECTRICAL RELAY APPARATUS

[75] Inventors: Walter E. Asbell, Westerville; Michael L. Thieken, Glenford, both of Ohio

[73] Assignee: American Telephone & Telegraph Company, AT&T Bell Laboratories, Murray Hill, N.J.

[21] Appl. No.: 15,714

[22] Filed: Feb. 17, 1987

[51] Int. Cl.[4] ..... H01H 1/66; H01H 51/01

[52] U.S. Cl. ..... 335/151; 335/83

[58] Field of Search ..... 335/131–133, 335/202, 151, 152, 153, 78–84, 128, 51, 57

[56] References Cited

U.S. PATENT DOCUMENTS

| | | | |
|---|---|---|---|
| 3,878,489 | 4/1975 | Rothweiler | 335/199 |
| 4,134,088 | 1/1979 | Asbell et al. . | |
| 4,292,614 | 9/1981 | Ono et al. | 335/132 |

*Primary Examiner*—E. A. Goldberg
*Assistant Examiner*—Lincoln Donovan
*Attorney, Agent, or Firm*—Dwight A. Marshall

[57] ABSTRACT

A relay (1) having terminal members (15) and a contact assembly (13) for selectively establishing electrical paths between the terminal members. The relay comprises structure (11, 12) mounting the contact assembly and arranged for slidably receiving the terminal members and wedging the terminal members in locked electrical engagement with the contact assembly.

11 Claims, 4 Drawing Sheets

ELECTRICAL RELAY APPARATUS

TECHNICAL FIELD

This invention relates to electrical relay apparatus.

BACKGROUND OF THE INVENTION

Miniature electrical relays have found wide and varied applications in the Telecommunications and Electronic Industry. Although solid state devices have recently replaced relays in many telecommunication and electronic systems, relays still offer many advantages in terms of cost and reliability in electrical circuit applications.

Relay constructions may comprise a base member molded of insulating material having terminal members embedded therein which extend below the relay base member and are formed to be inserted into holes drilled into a mounting surface, for example a circuit board, to mount the relay on the mounting surface. A bobbin member having a coil winding connected with ones of the terminal members embedded in the relay base member is generally positioned on the base member with the coil winding enclosing a contact assembly. The contact assembly has contact structures such as pole-piece members located at one end of an envelope member and a stem member located at the opposite end of the envelope member so as to engage the pole-piece members. The contact assembly pole-piece and stem members are wired to others of the terminal members embedded in the relay base member so that an electrical voltage applied to the relay terminal members connected to the bobbin coil winding generates a magnetic field to enable the contact assembly stem member to engage and disengage the pole-piece members and selectively establish electrical paths between ones of the other terminal members.

One problem arises with these relays in that holes must be drilled in the mounting surface. Another problem is that machines for installing the relays into the holes of the mounting surfaces must be designed so as to precisely align the relay terminal members with the mounting surface holes such that the relay may be installed on the mounting surface by inserting the relay terminal members into the holes without damaging either the terminal members of circuitry of the mounting surface. Yet another problem arises with these types of relays in that the terminal members are embedded in the relay base member thereby requiring molding machinery that precisely holds the terminal members during the process of molding the relay base member.

Accordingly, a need exists for an electrical relay having terminal members for mounting the relay on the surface of a circuit board without pre-drilling holes in the circuit board. A need also exists for a relay wherein terminal members for mounting the relay on a mounting surface may be installed on the relay without molding the terminal members in the relay base member.

SUMMARY OF THE INVENTION

The foregoing problems are solved and a technical advantage is achieved by a relay having terminal members and a contact assembly for selectively establishing electrical paths between ones of the terminal members. The relay comprises a construction mounting the contact assembly and having support structures for slidably receiving ones of the terminal members and wedging ones of the terminal members in the mounting construction in locked electrical engagement with the contact assembly.

In accordance with the invention, terminal members slidably received by structure mounting a relay contact assembly are formed of electrical conducting material to have a generally rectangular configuration formed with an embossment adjacent one end for locking the terminal members in the mounting structure and generally U-shaped or gull-wing shaped configuration at the opposite end for mounting the relay on the surface of a circuit board.

Also in accordance with the invention, a relay base member for mounting a bobbin member and contact assembly is formed of electrical insulating material to have a generally rectangular configuration and has a pair of support structures located at each end with slots formed therein along opposite sides for slidably receiving terminal members with each terminal member having a U-shaped segment configuration extended below the bottom surface of the base member to mount the relay on the surface of a circuit board.

Also in accordance with the invention, a relay bobbin member is positioned on a base member of the relay and mounts a coil winding enclosing a contact assembly for generating a magnetic field to operate the contact assembly. Opposite ends of the bobbin member each have opposing parallel beams extending outward therefrom for supporting terminal structures coupled with the coil winding and contact assembly and with each beam having a strut supporting a wedge-shaped structure located parallel to the beam for wedging relay terminal members in slots of the base member and locking the wedged terminal members in locked electrical engagement with the contact assembly.

In further accordance with the invention, a relay has contact terminals affixed to parallel beams extending outward from an end of a bobbin member having a coil wound thereon terminated on the contact terminals each having a contact surface positioned along a surface of a parallel beam for engaging a slidably received terminal member. The relay also has flexible contact members affixed to a contact assembly enclosed by the coil winding with each having a contact surface positioned on a bottom surface of one of the parallel beams and on a top surface of a wedge-shaped member supported by the beam for engaging ones of the terminal members slidably inserted in slots of a base member of the relay.

BRIEF DESCRIPTION OF THE DRAWINGS

The foregoing, as well as other objects, features and advantages of the invention, will be more apparent from a description of the drawing in which.

DESCRIPTION OF THE INVENTION

1. Apparatus

Figure 1:
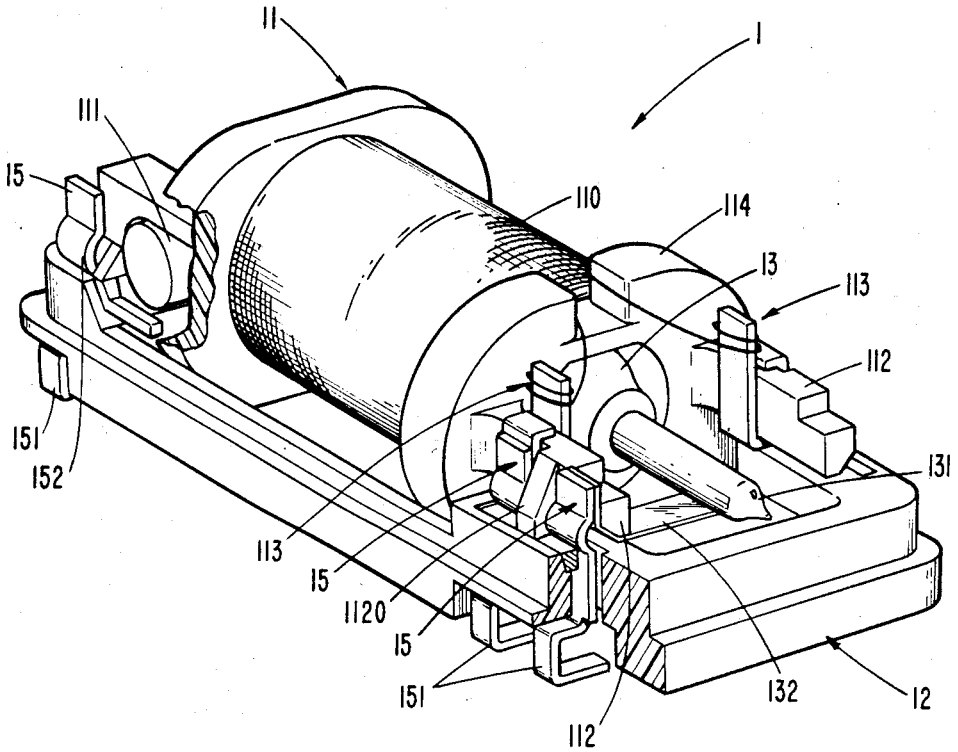
FIG. 1 depicts in perspective view an illustrative relay according to the invention with an enclosing cover removed to disclose various assembled operative members embodying the principles of the instant invention.

Referring to the drawing and more specifically to FIG. 1 of the drawing, relay 1 is a miniature relay intended for use in mounting on a surface, for example of a circuit board, and to function in operating circuitry both external to and located on the circuit board. Typically, relay 1 has a base member 12 on which is positioned a bobbin member 11 having a coil 110 wound thereon to enclose a contact assembly 13 coupled with ones of terminal members 15. Contact assembly 13, FIG. 2, may be any of a number of well-known contact assemblies oftentimes referred to as switches For the present embodiment of the invention, contact assembly 13, although not limited thereto, may comprise a glass envelope having a single or pair of parallel pole-piece members 130 located at one end of the envelope member and a stem member 131 located at the opposite end of the envelope member with a flexible armature attached to stem member 131 and positioned inside the envelope member so as to engage pole-piece members 130 Contact assembly 13 is positioned within bobbin member 11 so as to be enclosed by coil winding 110 and is electrically coupled with ones of terminal members 15. An electrical voltage applied to terminal members 15 electrically coupled to coil winding 110 causes coil winding 110 to generate a magnetic field that enables contact assembly 13 to selectively establish electrical paths between ones of terminal members 15 electrically coupled with contact assembly pole-pieces and stem members 130, 131. A cover member 10 is fitted onto base member 12 and sealed thereto to protect the relay.

Figure 3:
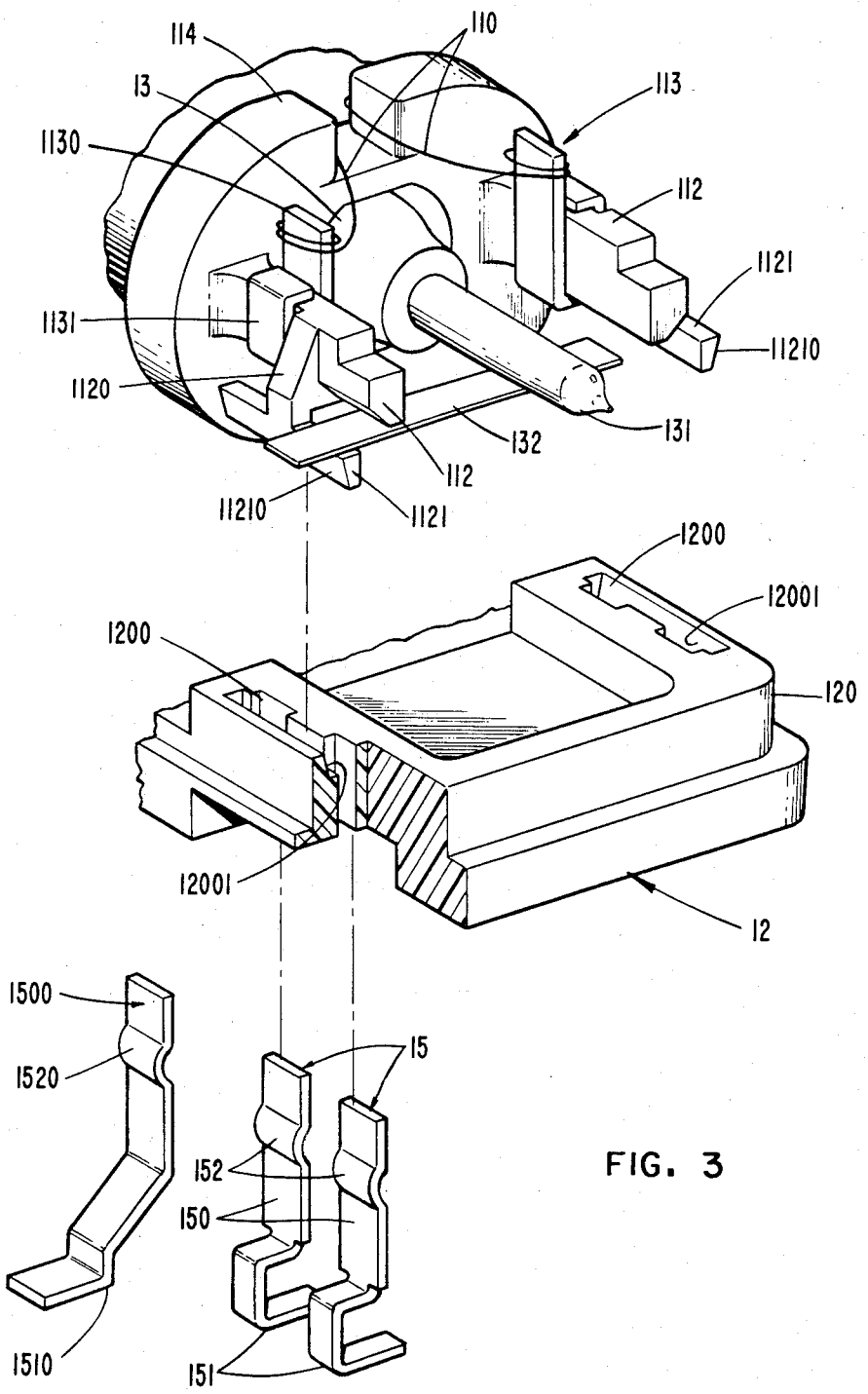
FIG. 3 an exploded perspective view showing the relationship of the relay contact assembly, bobbin, base and terminal members set forth in FIG. 2 embodying the principles of the instant invention.

As set forth in FIG. 3 of the drawing, relay terminal members 15, 1500 are formed of an electrical conducting material to have a generally rectangular configuration 150. An embossment or dimple 152, 1520 is formed adjacent one end and the opposite end is formed into a shaped segment such as a generally U-shaped or gull-wing shaped configuration 151, 1510 for use in mounting relay 1 on the surface of a circuit board such that relay 1 may be affixed by reflow soldering or by other soldering techniques to the circuitry of the circuit board.

Figure 2:
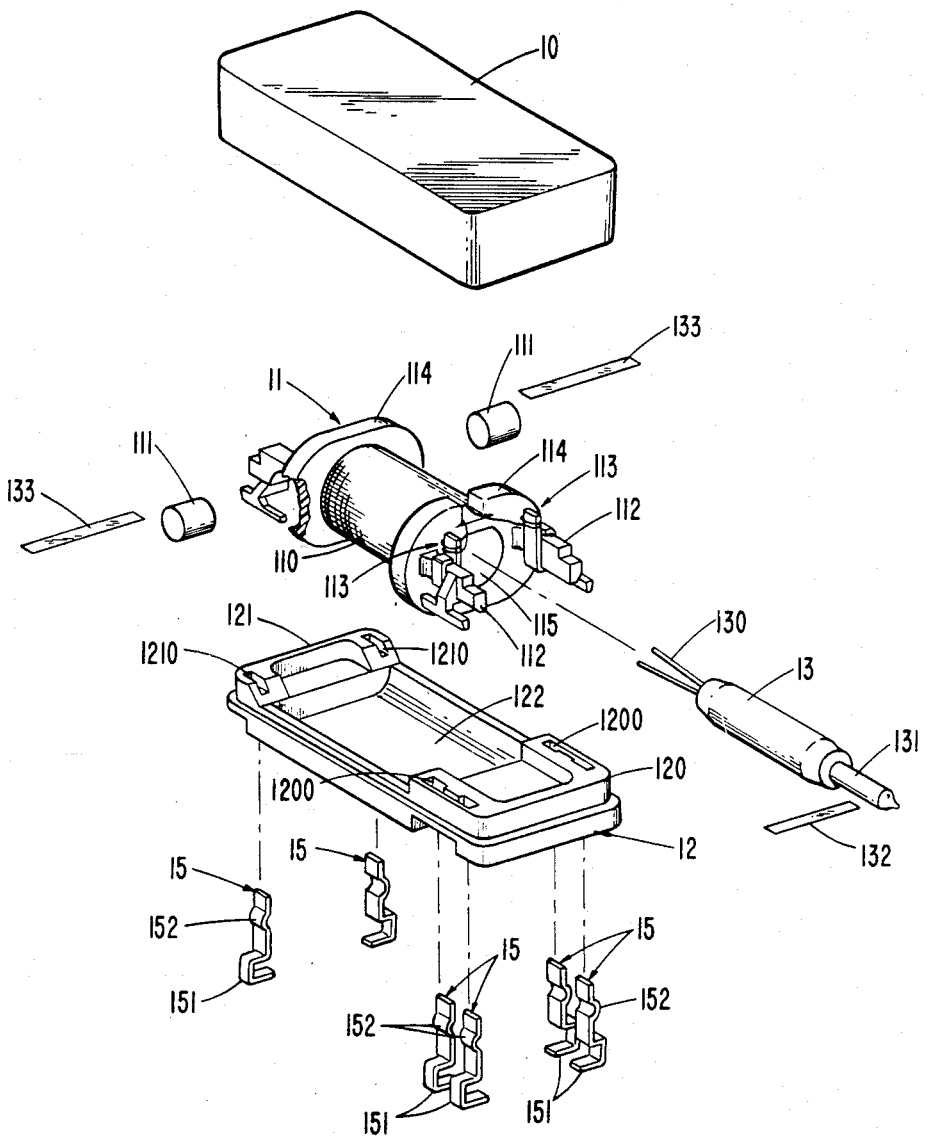
FIG. 2 is an exploded perspective view of the operative members relay set forth in FIG. 1.

Base member 12, FIG. 2, may be formed of any of a number of well-known electrical insulating materials to have a generally rectangular configuration with a pair of support structures 120, 121 located at each end for positioning bobbin member 11 on base member 12.

Each of the support structures 120, 121 has slots 1200, 1210 located along opposite sides and which are formed of a sufficient size to slidably receive the embossed end of a terminal member 15 with the U-shaped or gull-wing shaped configuration 151, 1510 extended below the bottom surface of base member 12 to rest on the surface of the circuit board.

Bobbin member 11 is formed of the electrical insulating material to have a generally cylindrical configuration with opposing ends 114 formed to position bobbin member 11 on base member 12. A coil 110 responsive to an applied electrical voltage for generating a magnetic field is wound around bobbin member 11 between opposing ends 114 to enclose contact assembly 13 located in a center bore 115 of bobbin member 11. Each of the bobbin member ends 114 have a pair of opposing parallel beams 112, FIG. 3, extending perpendicularly outward therefrom. Each parallel beam 112 has a strut 1120 centrally located thereon for supporting a wedge-shaped member 1121 located outside of and parallel to beam 112.

2. Assembly

In assembly, FIG. 3, contact terminals 113 formed of an electrical conducting material are affixed to ones of a pair of the bobbin member parallel beams 112. One end 1130 of each contact terminal 113 extending upward from the inside of a corresponding parallel beam 112 is provided for terminating coil winding 110. Each contact terminal 113 is formed around parallel beam 112 to position a contact surface 1131 along an outside surface of parallel beam 112 for engaging a corresponding one of the terminal members 15 slidably inserted in slots 1200 of base member 12.

Contact assembly 13 is then inserted into center bore 115 of bobbin member 11 with stem member 131 and pole members 130 extending outward from center bore 115 beyond the opposite ends 114 of bobbin member 11. Flexible contacts 132, 133 formed of electrical conducting material into a generally rectangular configuration each have one end affixed by bonding or any one of a number of well-known processes to a stem or pole piece member 131, 130 of contact assembly 13 with the other end extended as a contact surface to be positioned on a bottom surface of one of the parallel beams 112 and on a top surface of beam supported wedge member 1121.

Figure 4:
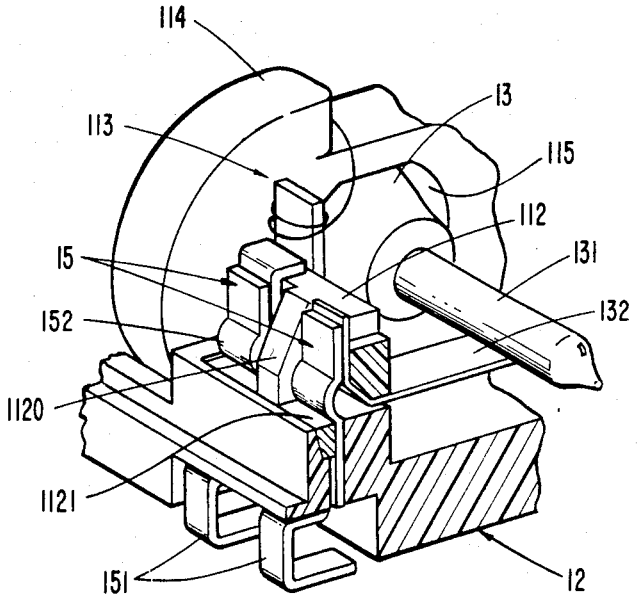
FIG. 4 is a perspective view of the contact assembly, bobbin, base and terminal members set forth in FIGS. 2 and 3 assembled in accordance with the principles of the instant invention.

Terminal members 15 are slidably inserted into slots 1200, 1210 such that the U-shaped or gull-winged shaped configuration 151, 1510 extends below the bottom surface for the purpose of mounting relay 1 on the surface of a circuit board. Bobbin member 11 is then positioned on base member 11 such that the terminal members 15 slidably inserted into base member slots 1200 extend upward between parallel beam 112 and wedge-shaped member 1121 to engage contact surfaces 1131 of contact terminals 113 and flexible contacts 132, 133. As bobbin member 11 is further positioned on base member 12, wedge-shaped members 1121 are inserted into base member slots 1200, 1210 such that the caming surface 11210 of wedge-shaped member 1121 engages the inner caming surface 12001 of base member slots 1200, 1210. As a result, ones of terminal members 15, FIG. 4, are wedged in electrical engagement with contact terminals 113, 133 connected to coil winding 110 and flexible terminals 130 connected with stem member 131 and pole-pieces members 132 of contact assembly 13. As the bobbin member wedge-shaped members 1121 are fully seated in base member slots 1200, 1210 terminal member embossments 152, 1520 function to lock wedged terminal members 15, 1500 in locked electrical engagement with contact terminals 113 terminating coil winding 110 and flexible contacts 132, 133 connected with stem and pole-piece members 131, 130 connected with contact assembly 13. Cover 10, FIG. 2, is placed over the relay and sealed to base member 12 to protect relay 1.

SUMMARY

It is obvious from the foregoing that the facility, economy and efficiency of relays may be substantially enhanced by a relay having terminal members arranged for mounting the relay on the surface of a circuit board without requiring that holes be pre-drilled on the circuit board to receive the relay terminals. It is further obvious that a relay structure for slidably receiving terminal members for mounting the relay on the surface of a circuit board without requiring that the terminal members be molded in a base member of the relay substantially improves the ease and reduces the cost of manufacturing the relay.

While the electrical relay of the instant invention has been disclosed with a glass enclosed contact assembly it to be understood that such an embodiment is intended to be illustrative of the principles of the invention and that numerous other arrangements may be devised by those skilled in the art without departing from the spirit and scope of the invention.

For example, the glass enclosed contact assembly may be replaced by an armature operated mechanical contact pileup whereby the coil winding enables a magnetic core member to operate the armature member to engage and disengage contacts to selectively establish paths between ones of the relay terminals.

What is claimed is:

1. A relay (1) having terminal means (15) comprising
a contact assembly (13) for selectively establishing electrical paths between the terminal means
Characterized in That
said relay comprises
means (11, 12) for slidably receiving ones of the terminal means and wedging said slidably received using wedge-shaped members (1121) to engage ones of the terminal means in said slidably receiving m in locked electrical engagement with the contact assembly.

2. The relay set forth in claim 1
Characterized in That
said one terminal means comprises
electrical conducting material having a generally rectangular configuration formed with an embossment (152) thereon adjacent one end for locking said one terminal means in said slidably receiving means and a shaped segment configuration (151) at the opposite end for mounting the relay on a surface of a circuit board.

3. The relay set forth in claim 2
Characterized in That
said slidably receiving means comprises
base member means (12) formed of electrical insulating material to have a generally rectangular configuration and having a pair of support structures (120, 121) located at each end thereof with slots (1200, 1210) formed therein along opposite sides for slidably receiving said one terminal means with each said slidably received terminal means shaped segment configuration extended below a bottom surface of said base member means.

4. The relay set forth in claim 3
Characterized in That
said slidably receiving means comprises
bobbin means (11) positioned on said base member means and mounting a coil winding (110) enclosing the contact assembly for generating a magnetic field to operate the contact assembly and having opposite ends (114) each with opposing pairs of parallel beams (112) extending outward therefrom for supporting others of said terminal means (113, 132, 133) coupled with said coil winding and contact assembly and each beam having strut means (1120) supporting said wedge-shaped member (1121) located parallel to said beams for wedging said slidably received one terminal means in said base member means slots and locking said wedged terminal means in locked electrical engagement with the contact assembly.

5. The relay set forth in claim 4
Characterized in That
said bobbin (113) means comprises
contact terminals (113) affixed to ones of said parallel beams and each having one end (1130) for terminating said coil winding and a contact surface (1131) positioned along one surface of said one parallel beams for engaging said slidably received terminal means.

6. The relay set forth in claim 4
Characterized in That
said bobbin means comprises
flexible contact means (132) affixed to the contact assembly and each having a contact surface positioned on a bottom surface of one of said parallel beams and on a top surface of said supported wedge means for engaging said one terminal means slidably inserted in said base member means slots.

7. A relay (1) comprising
a contact assembly (13) responsive to a magnetic field for selectively establishing electrical paths
Characterized in That
said relay comprises
a plurality of terminal members (15) each having a generally rectangular configuration formed with an embossment (152) thereon adjacent one end and generally U-shaped configuration (151) at the opposite end for mounting the relay on a surface,
a generally rectangular base member (12) formed in insulating material having a pair of support structures (120, 121) at each end thereof with slots (1200, 1210) formed along opposite sides for slidably receiving ones of said terminal members with each said terminal member U-shaped configuration extended below a bottom surface of said base member, and
a bobbin member (11) mounting a coil winding (11) enclosing the contact assembly for generating the magnetic field and having opposite ends each with opposing pairs of parallel beams (112) extending outward therefrom for supporting contact terminal (113, 132, 133) coupled with said coil winding and contact assembly and each having a strut (1120) supporting a wedge-shaped member (1121) parallel to said beams for wedging said received ones of said terminal members in said base member slots and locking said wedged terminal members in locked electrical engagement with the contact assembly.

8. A relay comprising
a contact assembly (13) having a pair of pole-piece members (130) at one end and a stem member (131) at an opposite end and responsive to a magnetic field for selectively establishing electrical paths between the stem and pole-piece members.
Characterized in That
said relay comprises
a plurality of electrical conducting terminal members (15) each having a generally rectangular configuration formed with an embossment (152) thereon adjacent one end and a generally U-shaped configuration (151) at the opposite end for mounting the relay on a surface,
a generally rectangular base member (12) formed of electrically insulating material and having a pair of support structures (120, 121) at each end thereof with slots (1200, 1210) formed along opposite sides for slidably receiving said terminal members with each said terminal member U-shaped configuration extended below a bottom surface of said base member, a bobbin member (11) formed of said insulating material and mounting a coil winding (110) enclosing the contact assembly for generating the magnetic field and having opposite ends (114) each with opposing pairs of parallel beams (112) extending outward therefrom and each beam having a strut (1120) supporting a wedge-shaped member (1121) parallel to said beam for wedging said terminal members in said base member slots and locking said wedged terminal members in said base member, a pair of electrically conducting contact terminals (113) each affixed to opposing ones of said parallel beams and each having one end (1130) for terminating said coil winding and a contact surface (1131) positioned along one surface of the corresponding parallel beam in wedged engagement with a received terminal member for electrically coupling the coil winding with said received terminal member, and a plurality of electrically conducting flexible contact members (132) each affixed to a corresponding one of the contact assembly pole-pieces and stem members and each having a contact surface positioned on a bottom surface of said bobbin member parallel beams and on a top surface of said supported wedge-shaped members for engaging ones of said terminal members slidably inserted in said base member slots.

9. The relay set forth in claim 8

Characterized in That said bobbin member comprises ones of said parallel beams formed with a depression therein for supporting a biasing magnet in magnetic engagement with a corresponding one of the contact assembly pole piece members.

10. The relay set forth in claim 8

Characterized in That said terminal members comprises a generally gull-wing configuration formed at said opposite end to extend outward from said base member for mounting the relay on the surface.

11. A relay comprising a contact assembly (13) having a pole-piece member (130) at one end and a stem member (131) at an opposite end and responsive to a magnetic field for establishing an electrical path between the stem and pole-piece member Characterized in That said relay comprises a plurality of electrical conducting terminal members (15) each having a generally rectangular configuration formed with an embossment (152) thereon adjacent one end and a generally U-shaped configuration (151) at the opposite end for mounting the relay on a surface, a generally rectangular base member (12) formed of electrically insulating material and having a pair of support structures (120, 121) at each end thereof with slots (1200) formed along opposite sides for slidably receiving said terminal members with each said terminal member U-shaped configuration extended below a bottom surface of said base member, a bobbin member (11) formed of said insulating material and mounting a coil winding (110) enclosing the contact assembly for generating the magnetic field and having opposite ends each with opposing pairs of parallel beams (112) extending outward therefrom and each beam having a strut (1120) supporting a wedge-shaped member (1121) parallel to said beam for wedging said terminal members in said base member slots and in combination with said embossment for locking said wedged terminal members in said base member, a pair of electrically conducting contact terminals (113) each affixed to opposing ones of said parallel beams and each having one end (1130) for terminating said coil winding and a contact surface (1131) positioned along one surface of the corresponding parallel beam in wedged engagement with a received terminal member for electrically coupling the coil winding with said received terminal member, and a plurality of electrically conducting flexible contact members (132, 133), of a generally rectangular configuration each having one end affixed to one of the contact assembly pole-pieces and stem members and each having a contact surface positioned on a bottom surface of said parallel beams and on a top surface of said supported wedge-shaped members for engaging said terminal members slidably inserted in said base member slots.

* * * * *